US010934843B2

(12) United States Patent
Spadacini et al.

(10) Patent No.: US 10,934,843 B2
(45) Date of Patent: Mar. 2, 2021

(54) RADIAL TURBOMACHINE WITH AXIAL THRUST COMPENSATION

(71) Applicant: EXERGY S.P.A., Bologna (IT)

(72) Inventors: Claudio Spadacini, Verbania Suna (IT); Dario Rizzi, Bisuschio (IT)

(73) Assignee: EXERGY INTERNATIONAL S.R.L., Olgiate Olona (IT)

( * ) Notice: Subject to any disclaimer, the term of this patent is extended or adjusted under 35 U.S.C. 154(b) by 158 days.

(21) Appl. No.: 16/090,420

(22) PCT Filed: Mar. 29, 2017

(86) PCT No.: PCT/IB2017/051783

§ 371 (c)(1),
(2) Date: Oct. 1, 2018

(87) PCT Pub. No.: WO2017/168334

PCT Pub. Date: Oct. 5, 2017

(65) Prior Publication Data

US 2019/0120056 A1 Apr. 25, 2019

(30) Foreign Application Priority Data

Mar. 30, 2016 (IT) ..... 102016000032690

(51) Int. Cl.
*F01D 5/04* (2006.01)
*F01D 1/06* (2006.01)
(Continued)

(52) U.S. Cl.
CPC ..... *F01D 5/048* (2013.01); *F01D 1/06* (2013.01); *F01D 3/00* (2013.01); *F01D 5/041* (2013.01); *F01D 3/02* (2013.01); *F01D 11/001* (2013.01)

(58) Field of Classification Search
CPC ... F01D 1/06; F01D 3/00; F01D 5/041; F01D 5/048
See application file for complete search history.

(56) References Cited

U.S. PATENT DOCUMENTS 997,629 A 7/1911 Ljungstrom
2,102,637 A 12/1937 Meininghaus
(Continued)

FOREIGN PATENT DOCUMENTS

WO 2015/140707 A1 9/2015
WO 2015/170230 A1 11/2015

OTHER PUBLICATIONS

Brasca et al., IT1405508.
(Continued)

*Primary Examiner* — David Hamaoui
*Assistant Examiner* — Brian O Peters
(74) *Attorney, Agent, or Firm* — Oliff PLC

(57) ABSTRACT

A radial turbomachine with axial thrust compensation includes a rotor disc with main bladed rings. The main bladed rings together with auxiliary bladed rings delimit a plurality of concentric front main chambers at different pressures. A plurality of concentric rear annular main chambers, each in fluid communication with a respective front main chamber and at the same pressure as the respective front main chamber, is delimited between a rear face of the rotor disc and a fixed casing. The concentric front main chambers are delimited by front areas of the rotor disc and concentric rear annular main chambers are delimited by rear annular areas of the rotor disc. All the rear annular areas are identical to the respective front areas except for one, which is a compensation area configured to compensate, at least in part, for the thrust of external pressure acting on the shaft.

13 Claims, 6 Drawing Sheets

(51) Int. Cl.

| | |
|---|---|
| ***F01D 3/00*** | (2006.01) |
| *F01D 11/00* | (2006.01) |
| *F01D 3/02* | (2006.01) |

(56) References Cited

U.S. PATENT DOCUMENTS 2,374,671 A * 5/1945 Dupont ..... F01D 1/06
415/83
2,626,501 A * 1/1953 Pavlecka ..... F01D 1/28
60/39.15

OTHER PUBLICATIONS

Jul. 10, 2017 International Search Report issued in International Patent Application No. PCT/IB2017/051783.
Jul. 10, 2017 Written Opinion issued in International Patent Application No. PCT/IB2017/051783.

* cited by examiner

A-4p
A-3p
A-2p
A-1p
A-a
X-X
A-4f
A-3f
A-2f
A-1f
1
2
3
4
5
6
7
8
9
9'
9''
9'''
9''''
10
11
12
13
14
15'
15''
15'''
16
19
24
25
26
27
28
29'
29''
29'''
29''''
30
31
32
33
34
35
36
37
38
39
40'
40''
40'''
40''''
41'
41''
41'''
41''''
42'
42''
42'''
42''''
43
44
45
46

RADIAL TURBOMACHINE WITH AXIAL THRUST COMPENSATION

FIELD OF THE INVENTION

The present invention relates to a radial turbomachine with axial thrust compensation. The present invention refers in particular to a system and a method for balancing axial thrust in radial turbomachines.

Radial turbomachine means a turbomachine in which the flow of the fluid with which it exchanges energy is directed in a radial direction for at least part of the path completed in the turbomachine itself. The radial part of the path is delimited by a plurality of bladed rotor rings mounted on a rotor disc and possibly also stator rings, through which the fluid moves prevalently along a radial direction relative to a rotation axis of the turbomachine.

A "bladed ring" comprises a plurality of blades arranged equidistant from a central axis of the turbomachine. The blades extend with their leading and trailing edges parallel or substantially parallel to the central axis. The bladed ring can have either the function of a stator (it is fixed relative to a casing of the turbomachine and its blades are stator blades) or a rotor (i.e. it rotates and its blades are rotor blades and thus the central axis is the rotation axis).

The present invention can be applied both to centrifugal radial (out-flow) turbomachines and centripetal (in-flow) ones. The present invention can be applied both to driving turbomachines (turbines) and operating ones (compressors). Preferably, but not exclusively, the present invention relates to expansion turbines. Preferably, but not exclusively, the present invention is applied to radial turbomachines with a single disc or two counter-rotating discs. Preferably, but not exclusively, the present invention relates to an expansion turbine for the production of electrical and/or mechanical energy. Preferably but not exclusively, the present invention refers to expansion turbines used in energy production apparatus, preferably via a steam Rankine cycle or organic Rankine cycle (ORC).

BACKGROUND OF THE INVENTION

In radial turbomachines, on the rotor disc, due to the expansion/compression of the working fluid, a pressure gradient is created between the machine inlet and discharge outlet. For example, in centrifugal radial turbines, the blades making up the first stage are the closest to the rotation axis of the machine, and thus the ones exposed to the highest pressure, whereas the blades of the last stage are the farthest, i.e. the ones exposed to the lowest pressure.

Furthermore, the pressure of the working fluid acting on a front face of the rotor disc, the pressure present behind the rotor disc and the atmospheric pressure which acts externally on the rotation shaft integral with the rotor disc generate a resultant axial force. This resultant axial force is discharged onto the rolling elements (e.g. ball bearings) that support the rotation shaft and can compromise the correct functioning of the same (which are not intended to withstand high axial thrusts).

In this field, there are known systems configured to balance at least partially the axial thrust generated by the pressure of the working fluid acting on the front face of the rotor disc.

Public document U.S. Pat. No. 997,629 illustrates a centrifugal radial turbine provided with labyrinth packings arranged on a face of the rotating disc opposite the one carrying the rotor vanes. The labyrinth packings are placed on an annular disc mounted on the rotor disc and on another annular disc mounted on the turbine casing. The packings are such that, if the annular discs move close to each other, they permit the passage of high-pressure steam, which causes the two annular discs to move apart again. The whole labyrinth packing is divided into groups, each of which acting as a self-balancing group independently of the others.

Public document IT1405508, in the name of the same applicant, illustrates an expansion turbine and a method for compensating for axial thrust in said expansion turbine. For this purpose, the expansion turbine comprises a sensor that is operatively active on a thrust bearing so as to directly detect the axial thrust, a compensation chamber delimited between the rotor and turbine casing, a means for introducing a compensation fluid into the compensation chamber, a control unit operatively connected to the sensor and to the introducing means, so as to adjust the introduction of the compensation fluid into the compensation chamber according to the axial thrust detected.

SUMMARY

In this context, the Applicant has perceived the need to propose a method and a system for compensating for axial thrust that are more effective and efficient than the known ones.

The Applicant has in fact noted that the solutions proposed in the prior art are not capable of correctly compensating for the thrust, particularly during the on and/or off switching transients of the turbomachine, and/or are so complex as to be scarcely reliable and generally very costly.

In particular, the Applicant has noted that the solution proposed in document U.S. Pat. No. 997,629 does not enables the balancing of axial thrust to be controlled with precision, because the radial distribution of pressure in the rear labyrinth packings, even if divided into groups, is unknown and cannot be correlated to the pressure acting on the front face of the disc, i.e. through the stages.

The Applicant has also noted that the active feedback control system proposed in document IT1405508 is difficult to set up and must be checked/calibrated with a certain frequency in order not to risk damaging the rolling elements. Consequently, said active control system, besides being scarcely reliable, is also costly.

The Applicant has thus set itself the following objectives:

- to propose a system and a method for balancing the axial thrust in radial turbomachines which makes it possible to reduce to a minimum or even cancel out the axial force acting on the rolling elements, so as to avoid stressing them excessively and increase their useful life;
- to propose a system and a method for balancing the axial thrust in radial turbomachines which are precise and reliable;
- to propose a system and a method for balancing the axial thrust in radial turbomachines which do their job effectively also during transients under partial loads (for example, during the switching on and/or off of the turbomachine);
- to propose a radial turbomachine which incorporates this balancing system and method and is also structurally simple;
- to propose a balancing system and method which are intrinsically safe.

The Applicant has found that the objectives specified above and still others can be reached through an axial thrust balancing system of the intrinsic type capable of individually balancing said axial thrust acting at every stage. In particular, the specified objectives and still others are substantially achieved by a radial turbomachine provided with annular chambers delimited on a rear face of every rotor disc, each connected to a respective annular chamber located on a front bladed face of the respective rotor disc, wherein the pressure of the working fluid acting in each rear chamber substantially balances the axial thrust generated by the pressure of the working fluid in the respective front chamber. In other words, the objective of the invention is to create pressure chambers on the back of the rotor disc that are equal in number to those created on the front surface of the same rotor disc and bring them to the same pressure.

The turbomachine which adopts this system is a turbomachine that is intrinsically balanced in an axial direction and does not require active controls.

In the present description and in the appended claims, the adjective "axial" is meant to define a direction directed parallel to a central axis of the bladed ring or the rotation axis "X-X" of the turbomachine. The adjective "radial" is meant to define a direction directed like the radii extending orthogonally from the central axis of the bladed ring or the rotation axis "X-X" of the turbomachine. The adjective "circumferential" means directions tangent to circumferences coaxial with the central axis of the bladed ring or the rotation axis "X-X" of the turbomachine.

In the present description and in the appended claims, "substantial axial balancing" means that the resultant axial force acting on the assembly formed by the rotor disc and the shaft (and which is discharged on the rolling elements) is either zero or of an entity such (for example, less than about 10000 N for a bearing with a 160 mm diameter shaft and a rotation speed of 1500 RPM) as to be able to be withstood without problems from the rolling elements.

More specifically, according to an independent aspect, the present invention relates to a radial turbomachine with axial thrust compensation, comprising:

a fixed casing;

a plurality of main concentric bladed rings arranged in the fixed casing around a central axis;

a plurality of concentric auxiliary bladed rings arranged in the fixed casing around said central axis; wherein the concentric auxiliary bladed rings are radially alternated with the main concentric bladed rings; wherein blades of said main bladed rings and of said auxiliary bladed rings delimit a radial path for a working fluid;

at least one rotor comprising a rotor disc and a rotation shaft integral with the rotor disc and rotatable in the fixed casing around the central axis, wherein the rotor disc carries, on a front face, the main bladed rings;

wherein said main and auxiliary bladed rings delimit, with the rotor disc, a plurality of concentric front chambers at different pressures;

wherein a plurality of concentric rear annular main chambers, each in fluid communication with a respective front main chamber and at the same pressure as said front main chamber, is delimited between a rear face of the rotor disc and the fixed casing;

wherein a rear annular area of the rotor disc delimiting one, preferably each, of the rear annular main chambers is equal to or substantially equal to a front area of said rotor disc delimiting a respective front main chamber, so that the force exerted by the pressure of the working fluid in each rear annular main chamber substantially balances the force exerted by the pressure of the working fluid in the respective front main chamber.

The Applicant has verified that in this manner it is possible to balance the rotor disc by substantially balancing the axial thrust acting on the front surface of the disc and the axial thrust acting on the rear surface of the same disc. This balancing is done individually for every area concentric with the central axis.

Further aspects of the invention are described hereinbelow.

In one aspect, the front main chambers comprise a substantially cylindrical central front chamber defining a front circular area, and a plurality of main annular chambers arranged around the central circular chamber, each defining a front annular area.

In one aspect, radial seals are interposed between a main bladed ring and a radially outermost auxiliary bladed ring to prevent the axial flow of the working fluid.

In one aspect, between said main bladed ring and a radially innermost auxiliary bladed ring, a respective axial passage for the working fluid is delimited.

In one aspect, each main bladed ring, together with a respective radially adjacent auxiliary bladed ring, defines a radial stage of the turbomachine.

In one aspect, the radial seals are interposed between radially adjacent stages and each main and auxiliary bladed ring of a same stage delimit the respective axial passage for the working fluid.

In one aspect, the respective axial passage for the working fluid is delimited between radially adjacent stages and the radial seals are interposed between each main and auxiliary bladed ring of a same stage.

In one aspect, said axial passage for the working fluid intersects the radial path and is in fluid communication with the radial path and with a respective main front annular chamber.

In other words, the radial seals are not placed between all of the bladed rings, but every two bladed rings. Where the radial seals are not present, the aforesaid axial passage, which is an annular volume extending axially parallel to the central axis, is defined. The fluid coming off the blades flows, in part, into the axial passage and fills the respective front main chamber and the respective rear annular main chamber. This makes it possible to have a seal between two successive main bladed rings (to reduce leakage) and always have pressure "available" for balancing the front and rear chambers.

In one aspect, a plurality of concentric main sealing rings is arranged at a rear face of the rotor disc, wherein said sealing rings, together with the fixed casing, delimit the rear annular main chambers.

In one aspect, each rear annular main chamber is located at the respective front main chamber. In one aspect, each rear annular main chamber is in fluid communication with a respective front main chamber through at least one duct formed in the rotor disc. Preferably, said duct extends substantially parallel to the central axis.

In one aspect, all of the rear annular areas are identical to the respective front areas except for one, called compensation area of the shaft; wherein said compensation area of the shaft corresponds to a rear annular compensation chamber. The rear annular areas which are identical to the respective front areas are intrinsically compensated for. The compensation area of the shaft serves to compensate, in whole or in part, as will be detailed further below, for the thrust of the external pressure acting on the shaft.

In one aspect, the rear annular compensation chamber is the one with a pressure closest to the external/atmospheric pressure.

In one aspect, the rear annular compensation chamber is the radially outermost.

In a different aspect, the rear annular compensation chamber is the radially innermost.

In one aspect, the radially outermost main bladed ring is located near a peripheral edge of the rotor disc.

In one aspect, the compensation area of the shaft is equal to the difference between the respective front area and a cross section area of the rotation shaft according to the following relationship:

$$A_4p=A_4f-A_a \quad \text{i)}$$

In this manner, the resultant axial force is not completely balanced but is nonetheless reduced and is a function of the difference between the pressure in the compensation chamber and the external/atmospheric pressure. Said resultant axial force is also a function of the cross section area of the shaft according to the following relation:

$$\text{Resultant}=A_a*(P4-P_\text{atm}) \quad \text{ii)}$$

This resultant is easily "withstandable" by the ball bearings that are normally used, particularly in radial turbines for organic fluids (i.e. configured to work with organic fluids, preferably at a high molecular weight). For typical pressure values, the resultant is at most a few thousand Newtons. Such resultant forces can be withstood without problems by normal rolling bearings.

Furthermore, the resultant force is almost independent of the following factors:

inlet pressure;
load of the turbomachine;
type of working fluid and thus cycle;
number of stages of the turbomachine;
degree of reaction of the stages.

It follows that the present invention makes it possible to:

increase the life of bearings or, more in general, of the rolling elements;
provide an intrinsically safe (fail-safe) turbomachine;
provide a flexible solution;
provide a self-adjusting balancing for different design conditions;
provide a self-adjusting balancing for off-design conditions.

In one aspect, the compensation area of the shaft is equal to the sum of the respective front area and a factor that is a function of the cross section area of the rotation shaft and of the external/atmospheric pressure. In this manner, it is possible to completely cancel out the resultant axial force, at least under design conditions.

In one aspect, in order to completely cancel out the resultant axial force, the compensation area of the shaft is equal to:

$$A'_4p=A_4f+A_a*(P\text{out}-P_\text{atm})/(P4-P\text{out}) \quad \text{iii)}$$

In other words, compared to the case in which the resultant axial force is not completely balanced (A_4*p*=A_4*f*−A_a), the compensation area of the shaft is increased by an additional area equal to:

$$A5_f=A_a*(P4-P_\text{atm})/(P4-P\text{out}) \text{ and} \quad \text{iv)}$$

$$A'_4p=A_4p+A5_f \text{ so that the relation iii) is obtained} \quad \text{v)}$$

In one aspect, said additional area is obtained by increasing the diameter of the radially outermost seal, i.e. the diameter of the radially outermost rear annular compensation chamber. This additional area on the outer diameter of the rotor disc normally requires (depending on the pressures in play) an increase of a few millimetres relative to the diameter of the last rotor and is therefore simple to achieve and has no substantial limitations. In this configuration, the peripheral edge of the rotor disc extends radially beyond the radially outermost main bladed ring.

In one aspect, each main and auxiliary bladed ring comprises a plurality of blades arranged equidistant from a central axis and joined together by two concentric rings (a root ring and a circling ring) axially spaced from each other. The blades extend between said two rings with their leading and trailing edges parallel or substantially parallel to the central axis. The bladed ring can have either the function of a stator (it is fixed relative to a casing of the turbomachine and its blades are stator blades) or a rotor (i.e. it rotates and its blades are rotor blades and thus the central axis is the rotation axis).

In one aspect, each main and auxiliary bladed ring comprises a connecting ring directly connected to the root ring and having one end joined to the respective first or second rotor disc or to the fixed casing.

In one aspect, the connecting ring is elastically yielding, that is, it permits a radial deformation of the same when subjected to the loads of the turbomachine as a function of the temperature (and, if rotating, centrifugal force as well).

In one aspect, the radial seals are arranged on a radially inner surface or on a radially outer surface of the root ring and of the circling ring belonging to a bladed ring. The radial seals are set on a single diameter.

In one aspect, the radial seals comprise sealing elements mounted on a radially inner surface or on a radially outer surface of the root ring and of the circling ring cooperating with a radially outer surface or a radially inner surface of the adjacent circling ring and root ring.

In one aspect, each of the main sealing rings comprises: a root ring connected to the fixed casing by means of a connecting ring.

In one aspect, the rotor disc comprises a plurality of annular projections coaxial with the central axis, each operatively coupled to a respective main sealing ring. In one aspect, radial seals are interposed between the root ring of every main sealing ring and a respective annular projection.

In one aspect, there is only one rotor and pairs of radially adjacent bladed rings delimit, with the rotor disc, a main front annular chamber and, with the fixed casing, an auxiliary front annular chamber, wherein said main and auxiliary front annular chambers are mutually connected by the respective axial passage.

In one aspect, the concentric auxiliary bladed rings are fixed to the fixed casing.

The turbomachine is of the radial type with a single rotor disc and said rotor disc is provided with the rear annular main chambers for balancing the axial thrust.

In a different aspect, the turbomachine comprises a first rotor and a second rotor.

The first rotor comprises a first rotor disc and a first rotation shaft integral with the first rotor disc and rotatable in the fixed casing around the central axis, wherein the first rotor disc carries, on a front face, the main concentric bladed rings. The second rotor comprises a second rotor disc and a second rotation shaft integral with the second rotor disc and rotatable in the casing around the central axis, wherein the second rotor disc carries, on a front face, the concentric auxiliary bladed rings.

In one aspect, the first and the second rotor are counter-rotating. The turbomachine is of the counter-rotating radial type and both discs are provided with the rear chambers (main and auxiliary) for balancing the axial thrust.

In one aspect, pairs of radially adjacent bladed rings delimit, with the first rotor disc, a main front annular chamber and, with the second rotor disc, an auxiliary front annular chamber, wherein said main and auxiliary front annular chambers are mutually connected by the respective axial passage.

In one aspect, a plurality of concentric main sealing rings are arranged at a rear face of the first rotor disc, wherein said main sealing rings, together with the fixed casing, delimit a plurality of rear annular main chambers; wherein each rear annular main chamber is in fluid communication, through at least one duct formed in the first rotor disc, with a respective front main chamber; wherein a rear annular area of the first rotor disc delimiting one of the rear annular main chambers is substantially equal to a front annular area of said first rotor disc delimiting a respective front main chamber, so that the force exerted by the pressure of the working fluid in each rear annular main chamber substantially balances the force exerted by the pressure of the working fluid in the respective front main chamber.

In one aspect according to the preceding aspect, a plurality of concentric auxiliary sealing rings are arranged at a rear face of the second rotor disc, wherein said auxiliary sealing rings, together with the fixed casing, delimit a plurality of auxiliary rear annular chambers; wherein each auxiliary rear annular chamber is in fluid communication, through at least one duct formed in the second rotor disc, with a respective auxiliary front annular chamber; wherein a rear annular area of the second rotor disc delimiting one of the auxiliary rear annular chambers is substantially equal to a front annular area of said second rotor disc delimiting a respective auxiliary front annular chamber, so that the force exerted by the pressure of the working fluid in each auxiliary rear annular chamber substantially balances the force exerted by the pressure of the working fluid in the respective auxiliary front annular chamber.

In one aspect, the radial turbomachine is centrifugal. In a different aspect, the radial turbomachine is centripetal.

In one aspect, the radial turbomachine is a turbine. In a different, aspect, the radial turbomachine is a compressor.

In one aspect, the radial turbomachine is configured to work with an organic fluid, preferably with a high molecular weight. Typically, in the turbines used for the expansion of organic fluids in ORC (Organic Rankine Cycle) cycles/systems, the pressure of the working fluid at the outlet and in the last stage (usually comprised between about 0.5 and 1.5 bar) is the closest to atmospheric pressure. It is thus advisable to choose, as a compensation area of the shaft, the area of the outermost rear annular chamber (located, precisely, at the last stage). This choice makes it possible to reduce the resultant axial force to a minimum if the first radially outermost bladed ring is located near the peripheral edge of the rotor disc or to cancel out said resultant axial force by slightly increasing the diameter of the rotor disc, as will be explained in the following detailed description.

In a different aspect, the radial turbomachine is configured to work with steam. Additional features and advantages will become more apparent from the detailed description of preferred, but not exclusive, embodiments of a radial turbomachine with axial thrust compensation, according to the present invention.

DESCRIPTION OF THE DRAWINGS

This description will be given below with reference to the attached drawings, provided solely for illustrative and therefore non-limiting purposes, in which.

DETAILED DESCRIPTION

With reference to the aforementioned figures, the reference number 1 denotes in its entirety a radial turbomachine with axial thrust compensation.

Figure 1:
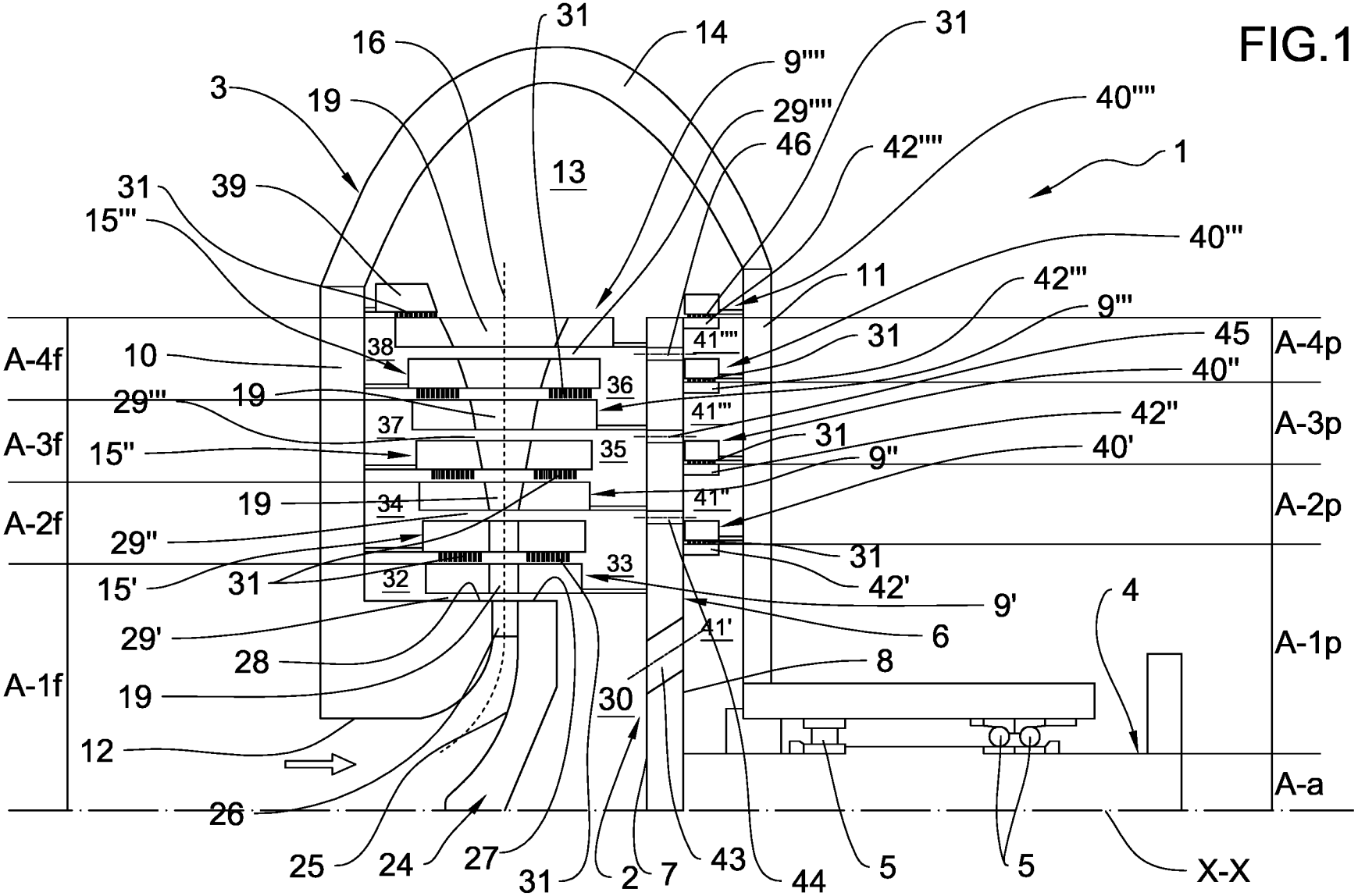
FIG. 1 illustrates a meridian section of a radial turbomachine with axial thrust compensation according to the present invention.

The radial turbomachine 1 illustrated in FIG. 1 is an expansion turbine of the centrifugal radial type with a single rotor 2. For example, the turbine 1 can be employed in the field of electricity generating plants of the Organic Rankine Cycle (ORC) type which, for example, exploit geothermal resources as sources.

The turbine 1 comprises a fixed casing 3 in which the rotor 2 is housed in such a way as to be able to rotate. For this purpose the rotor 2 is rigidly connected to a shaft 4 that extends along a central axis "X-X" (which coincides with a rotation axis of the shaft 4 and rotor 2) and is supported in the fixed casing 3 by appropriate bearings 5. The rotor 2 comprises a rotor disc 6 directly connected to the aforesaid shaft 4 and provided with a front face 7 and an opposite rear face 8. The front face 7 supports a plurality of projecting main bladed rings 9 (rotor type), which are concentric and coaxial with the central axis "X-X" and thus rotate with the rotor disc 6.

The fixed casing 3 comprises a front wall 10, situated opposite the front face 7 of the rotor disc 6, and a rear wall 11, located opposite the rear face 8 of the rotor disc 6. The front wall 10 has an opening defining an axial inlet 12 for a working fluid. The axial inlet 12 is located at the central axis "X-X" and is circular and concentric with the same axis "X-X". The fixed casing 3 further has a spiral pathway 13 for the working fluid located in a peripheral, radially outer position relative to the rotor 2 and in fluid communication with an outlet, not illustrated, of the fixed casing 3. The spiral pathway 13 is delimited by a peripheral portion 14 of the fixed casing 3.

The front wall 10 supports a plurality of projecting auxiliary bladed rings (stator type) 15 which are concentric and coaxial with the central axis "X-X". The auxiliary bladed rings 15 extend from an inner face of the front wall 10 towards the inside of the casing 3 and towards the rotor disc 6 and are radially alternated with the main bladed rings 9 so as to define a radial expansion path 16 for the working fluid which enters through the axial inlet 12 and expands as it moves away radially towards the periphery of the rotor disc 2 until entering the spiral pathway 13 and then exiting the fixed casing 3 through the aforesaid outlet, not illustrated.

The main and auxiliary bladed rings 9, 15 all have a similar structure, apart from their dimensions and some dimensional ratios. The structure of a main bladed ring 9 will be described below with reference to FIG. 4.

Figure 4:
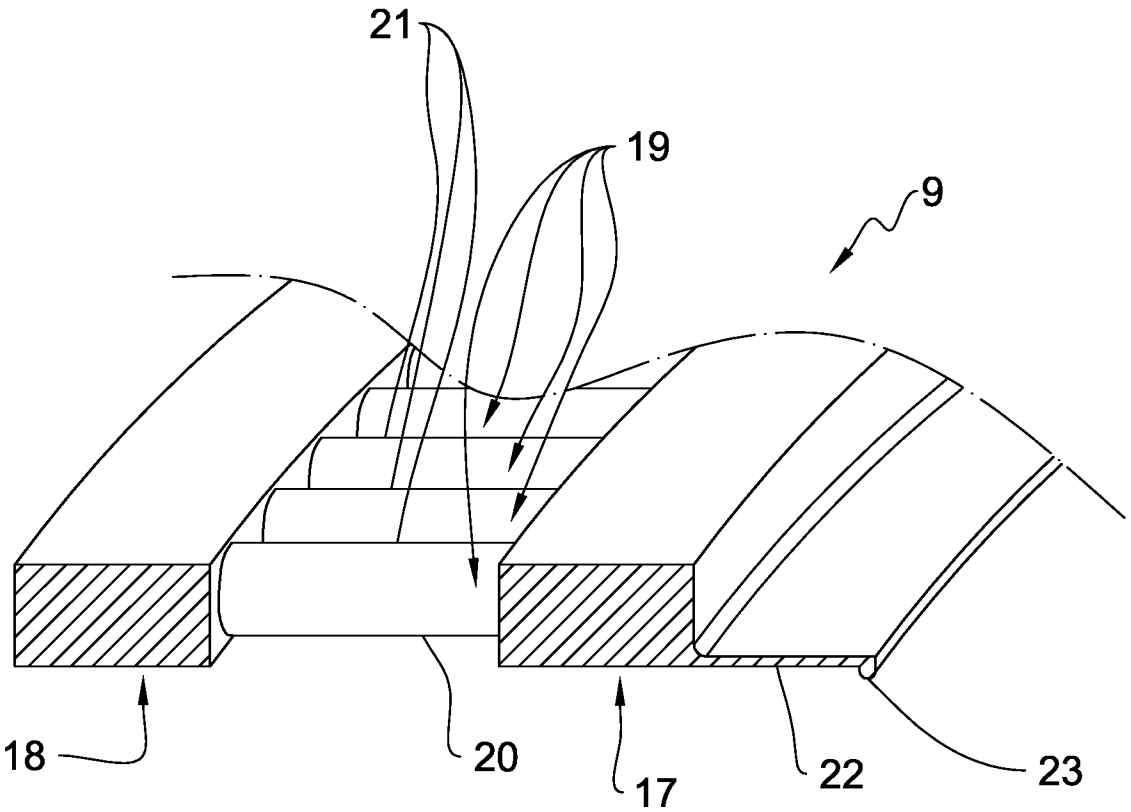
FIG. 4 is a perspective view of a portion of a bladed ring of the turbomachines as per the preceding figures.

The main bladed ring 9 of FIG. 4 comprises a root ring 17 and a circling ring 18 coaxial with the central axis "X-X", of similar dimensions and axially spaced from one another.

The blades 19 are arranged equidistant from the central axis "X-X" and are joined to one another by the root ring 17 and circling ring 18. The blades 19 extend between said two rings 17, 18 with their leading edges 20 and trailing edges 21 parallel or substantially parallel to the central axis "X-X". Since the turbomachine 1 illustrated is a centrifugal radial turbine, in which the working fluid moves radially towards the outside, the leading edge 20 of every blade 19 is turned radially towards the inside, that is, towards said central axis "X-X", and the trailing edge 21 is turned radially towards the outside.

The main bladed ring 9 comprises a connecting ring 22 which extends axially from the root ring 17 and is likewise coaxial with the central axis "X-X". As may be seen in FIG. 4, the connecting ring 22 has a much smaller radial thickness than the root ring 17, for example equal to about 1/10 the thickness of the root ring 17. One annular end 23 of the connecting ring 22 is provided with a sort of foot for the connection with the front face of the rotor disc 6. The reduced thickness (compared to the root ring 17) of the connecting ring 22 renders it elastically yielding, i.e. it permits a radial deformation thereof when it is subjected to the loads of the turbine 1 (as a function of the temperature and centrifugal force).

The turbine 1 illustrated in FIG. 1 comprises a deflector 24, or nose, located in the fixed casing along the central axis "X-X" and facing towards the axial inlet 12. The deflector 24 delimits, with an inner wall of the fixed casing 3 situated near the axial inlet 12, a connecting duct 25 which connects the axial inlet 12 with the radial expansion path 16. The deflector 24 has the profile of a bulging disc with a convex face turned towards the axial inlet 12.

A radially peripheral portion of the deflector 24 carries a series of stator blades 26 arranged around the central axis "X-X" and equidistant from the central axis "X-X". Said stator blades 26 extend between a tubular portion of the fixed casing 3 and the radially peripheral portion of the deflector 24 with their leading and trailing edges parallel or substantially parallel to the central axis "X-X". Said stator blades 26 are located in the connecting duct 25 and are the first fixed blades of the radial expansion path 16 that the fluid entering the turbine 1 meets.

Located in a radially outer position relative to the aforesaid stator blades 26 there is a first main rotor bladed ring 9, the radially innermost one, constrained to the rotor disc 6. The rotor blades 19 of the first main rotor bladed ring 9 are set in a position corresponding to that of the stator blades 26 fixed to the deflector 24 and together they form a first stage of the turbine 1.

Figure 2:
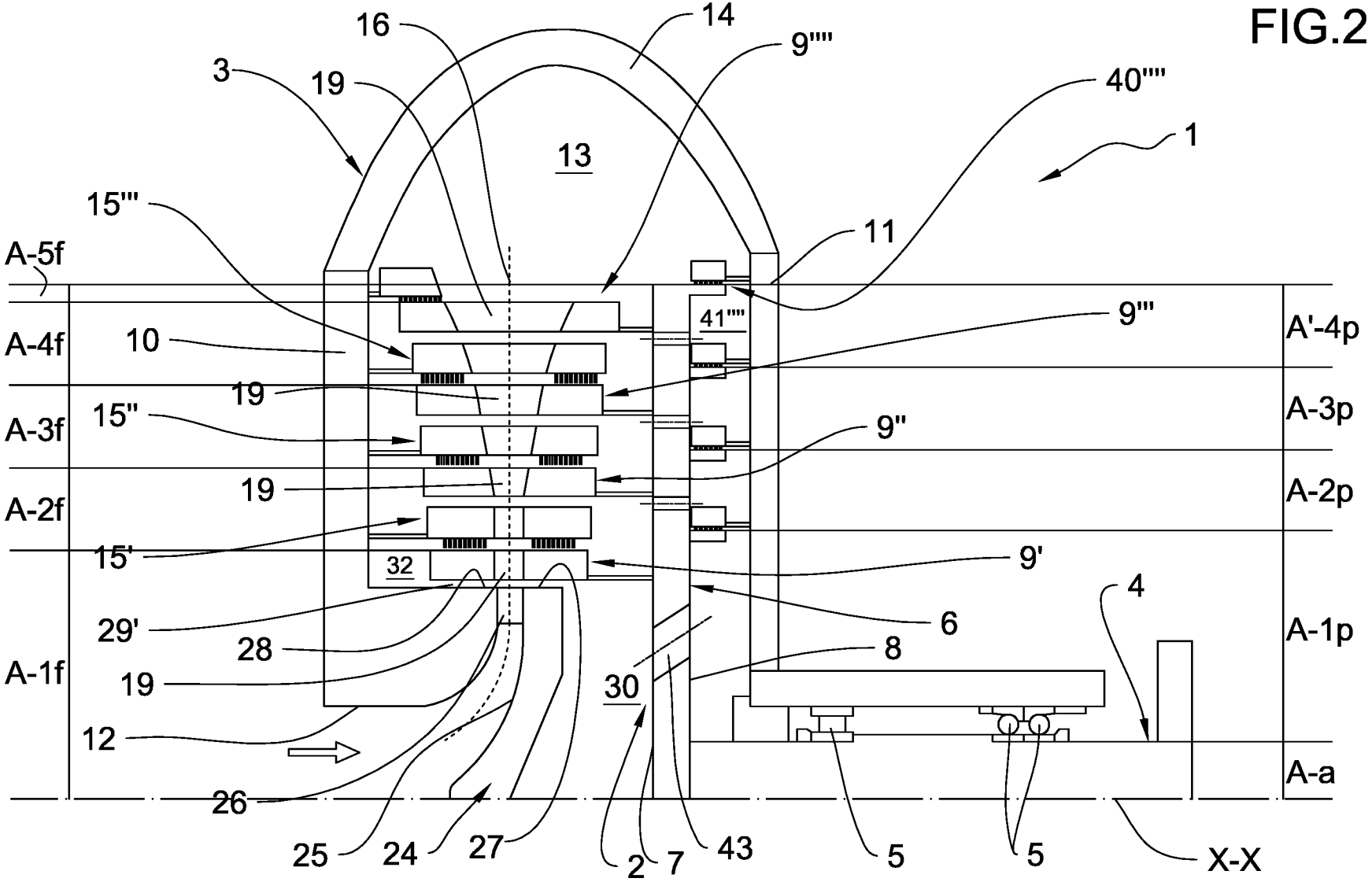
FIG. 2 illustrates a variant of the turbomachine of FIG. 1.

As may be seen in FIGS. 1 and 2, between a radially inner surface of the root ring 17 of the first main rotor bladed ring 9 and a radially outer surface 27 of the radially peripheral portion of the deflector 24 and between a radially inner surface of the circling ring 18 of the first main rotor bladed ring 9 and a radially outer surface 28 of the tubular portion of the fixed casing 3 a first axial passage 29' is delimited, i.e. an axially extending annular volume parallel to the central axis "X-X". No seals are placed in the first axial passage 29' and it intersects the radial expansion path 16. Therefore, the fluid coming off the stator blades 26 is free to fill the first axial passage 29'. The first axial passage 29' is at the outlet pressure of the stator blades 26.

One face of the deflector 24, opposite the convex one, is turned towards the rotor disc 6 and delimits, with a radially inner portion of the front face 7 of the rotor disc 6 and the first main rotor bladed ring 9', a substantially cylindrical central front chamber 30 in fluid communication with the aforesaid first axial passage 29'. Said substantially cylindrical central front chamber 30 is thus likewise at the outlet pressure of the stator blades 26.

A first auxiliary stator bladed ring 15' is located in a radially outer position relative to the first main rotor bladed ring 9'. The stator blades 19 of the first auxiliary stator bladed ring 15' are set in a position corresponding to that of the rotor blades 19 of the first radially innermost main rotor bladed ring 9'.

As may be seen in FIGS. 1 and 2, between a radially outer surface of the root ring 17 of the first main rotor bladed ring 9' and a radially inner surface of the circling ring 18 of the first auxiliary stator bladed ring 15' and between a radially outer surface of the circling ring 18 of the first main rotor bladed ring 9' and a radially outer surface of the root ring 17 of the first auxiliary stator bladed ring 15' there are radial seals 31 which prevent the passage of the working fluid coming off the blades 19 of the first stage.

The radial seals 31 comprise sealing elements mounted on the radially inner surface of the root ring 17 and circling ring 18 cooperating with the radially outer surface of the adjacent circling ring 18 and root ring 17. The sealing elements are, for example, annular walls projecting radially from the surface which supports them and graze or touch the opposing surface. The radial seals 31 just described are set on a single diameter.

A terminal axial end of the first main rotor bladed ring 9', or, more precisely, a head surface of the circling ring 18 of said first main rotor bladed ring 9' is spaced from the inner face of the front wall 10 of the fixed casing 3. Said head surface, together with a portion of the front wall 10 and together with the first auxiliary stator bladed ring 15', delimits a first auxiliary front annular chamber 32.

A terminal axial end of the first auxiliary stator bladed ring 15', or, more precisely, a head surface of the circling ring 18 of said first auxiliary stator bladed ring 15', is spaced from the front face 7 of the rotor disc 6. Said head surface, together with a portion of the front face 7 of the rotor disc 6, the first main rotor bladed ring 9' and a second main rotor bladed ring 9", delimits a first main front annular chamber 33. The aforesaid portion of the front face 7 of the rotor disc 6 defines a front annular area of the rotor disc 6.

The second main rotor bladed ring 9" is located in a radially outer position relative to the first auxiliary stator bladed ring 15' and the rotor blades 19 of the second main rotor bladed ring 9" are set in a position corresponding to that of the blades 19 of the first auxiliary stator bladed ring 15' and together they form a second stage of the turbine 1.

As may be seen in FIGS. 1 and 2, between a radially inner surface of the root ring 17 of the second main rotor bladed ring 9" and a radially outer surface of the circling ring 18 of the first auxiliary stator bladed ring 15' and between a radially inner surface of the circling ring 18 of the first main rotor bladed ring 9' and a radially outer surface of the root ring 17 of the first auxiliary stator bladed ring 15' a second axial passage 29" is delimited, i.e. an axially extending annular volume parallel to the central axis "X-X". No seals are placed in the second axial passage 29" and it intersects the radial expansion path 16. Therefore, the fluid coming off the blades 19 of the first auxiliary stator bladed ring 15' is free to fill the second axial passage 29". The second axial passage 29" is at the outlet pressure of the blades 19 of the first auxiliary stator bladed ring 15' and is in fluid communication with the first front main chamber 33, which is thus at the same pressure.

A terminal axial end of the second main rotor bladed ring 9", or, more precisely, a head surface of the circling ring 18 of said second main rotor bladed ring 9", is spaced from the inner face of the front wall 10 of the fixed casing 3. Said head surface, together with a portion of the front wall 10 and together with the first auxiliary stator bladed ring 15', delimits a second auxiliary front annular chamber 34. The second axial passage 29" is also in fluid communication with the second auxiliary front annular chamber 34.

The turbine 1 comprises a second auxiliary stator bladed ring 15", a third main rotor bladed ring 9'", a third auxiliary stator bladed ring 15'", and a fourth main rotor bladed ring 9"". Their structure is substantially identical to the structure detailed hereinabove.

Radial seals 31 are placed between the third main rotor bladed ring 9'" and the third auxiliary stator bladed ring 15'" and between the second main rotor bladed ring 9" and the second auxiliary stator bladed ring 15". Thus delimited are: a second main front annular chamber 35 and a third main front annular chamber 36, a third auxiliary front annular chamber 37 and a fourth auxiliary front annular chamber 38. A third axial passage 29'" puts the second main front annular chamber 35 in communication with the third auxiliary front annular chamber 37, so that both are at the same pressure. A fourth axial passage 29"" puts the third main front annular chamber 36 in communication with the fourth auxiliary front annular chamber 38, so that both are at the same pressure.

Each main front annular chamber 33, 35, 36 corresponds to a respective front annular area of the rotor disc 6. The substantially cylindrical central front chamber 30 corresponds to a front circular area of the rotor disc 6.

The turbine 1 further comprises a radially outer sealing ring 39 which extends from the inner face of the front wall 10 towards the inside of the casing 3 and surrounds the circling ring 18 of the fourth main rotor bladed ring 9"". The radially outer sealing ring 39 is not bladed but has the structure of a root ring 17 connected to the fixed casing 3 by means of a connecting ring 22. Radial seals 31 are interposed between the radially outer sealing ring 39 and circling ring 18 of the fourth main rotor bladed ring 9" to prevent the direct passage of fluid from the fourth auxiliary front annular chamber 38 to the spiral pathway 13, that is, to prevent the fluid from bypassing the blades 19 of the fourth main rotor bladed ring 9"".

The turbine 1 further comprises three concentric main sealing rings 40', 40", 40'", 40"", which are arranged on the rear face 8 of the rotor disc 6. The main sealing rings 40', 40", 40'", 40"", together with the fixed casing 3, delimit four rear annular main chambers 41', 41", 41'", 41"".

In greater detail, every main sealing ring 40', 40", 40'", 40"" is structurally similar to the radially outer sealing ring 39 and thus comprises a root ring 17 connected to the fixed casing 3 by means of a connecting ring 22. Radial seals 31 are interposed between the root ring 17 of every main sealing ring 40', 40", 40'", 40"" and a respective annular projection 42', 42", 42'", 42"" integral with the rotor disc 6 and coaxial with the central axis "X-X".

A first rear annular main chamber 41' is delimited by a first annular area of the rear face 8 of the rotor disc 6, a first annular portion of the rear wall 11 of the fixed casing 3, a first radially innermost rear sealing ring 40' and the shaft 4. A plurality of first ducts 43 (only one of which is visible in FIG. 1) passing through the rotor disc 6 put the first rear annular main chamber 41' in fluid communication with the substantially cylindrical front chamber 30. Therefore, the first auxiliary front annular chamber 32, the first axial passage 29', the substantially cylindrical front chamber 30 and the first rear annular chamber 41' are all at a same first pressure "P1".

A second rear annular main chamber 41" is delimited by a second rear annular area of the rotor disc 6, the first rear sealing ring 40', a second rear sealing ring 40" and a second annular portion of the rear wall 11 of the fixed casing 3. A plurality of second ducts 44 (only one of which is visible in FIG. 1) passing through the rotor disc 6 parallel to the central axis "X-X" put the second rear annular main chamber 41" in fluid communication with the first main front annular chamber 33. Therefore, the second auxiliary front annular chamber 34, the second axial passage 29", the second rear annular main chamber 41" and the first main front annular chamber 33 are all at a same second pressure "P2".

A third rear annular main chamber 41'" is delimited by a third rear annular area of the rotor disc 6, the second rear sealing ring 40", a third rear sealing ring 40'" and a third annular portion of the rear wall 11 of the fixed casing 3. A plurality of third ducts 45 (only one of which is visible in FIG. 1) passing through the rotor disc 6 parallel to the central axis "X-X" puts the third rear annular main chamber 41'" in fluid communication with the second main front annular chamber 35. Therefore, the third auxiliary front annular chamber 37, the third axial passage 29'", the third rear annular main chamber 41'" and the second main front annular chamber 35 are all at a same third pressure "P3".

A fourth rear annular main chamber 41"" is delimited by a fourth rear annular area of the rotor disc 6, the third rear sealing ring 40'", a fourth rear sealing ring 40"" and a fourth annular portion of the rear wall 11 of the fixed casing 3. A plurality of fourth ducts 46 (only one of which is visible in FIG. 1) passing through the rotor disc 6 parallel to the central axis "X-X" puts the fourth rear annular main chamber 41"" in fluid communication with the third main front annular chamber 36. Therefore, the fourth auxiliary front annular chamber 38, the fourth axial passage 29"", the fourth rear annular main chamber 41"" and the third main front annular chamber 36 are all at a same fourth pressure "P4".

The working fluid that enters through the axial inlet 12 with an inlet pressure "Pin", after passing through the stator blades 26, has the first pressure "P1". Said first pressure "P1" acts on a first front area "A_1*f*" (generating a thrust F1_*f*=P1*A_1*f*) of the rotor disc 6 equal to the sum of the front circular area of the rotor disc 6 and the area of the head surface of the circling ring 18 of the first main rotor bladed ring 9'.

The same first pressure "P1" acts on a first rear annular area "A_1*p*" of said rotor disc 6, generating an opposite thrust F_1*p*=P1*A_1*p*. Said first rear annular area "A_1*p*" is equal to the area of the rear face 8 of the rotor disc 6 which belongs to the first rear annular main chamber 41' and surrounds the shaft 4. The first front area "A_1*f*" is equal to the first rear annular area "A_1*p*", so that the resultant thrust is zero (F1_*f*=F_1*p*).

Continuing along the radial expansion path 16, the working fluid passes through the blades 19 of the first main bladed ring 9' and of the first auxiliary bladed ring 15'. Just downstream of the first auxiliary bladed ring 15', the working fluid has the second pressure "P2". Said second pressure "P2" generates a thrust F_2*f*=P2*A_2*f*. The second front annular area "A_2*f*" is equal to the sum of the area of the head surface of the circling ring 18 of the second main rotor bladed ring 9" and the difference between the annular area of the front face 7 of the rotor disc 6 contained in the first front main chamber 33 and the area of the head surface of the root ring 17 of the first main rotor ring 9' turned towards said rotor disc 6.

The same second pressure "P2" acts on a second rear annular area "A_2*p*" of said rotor disc 6, generating an opposite thrust F_2p=P2*A_2p. Said second rear annular area "A_2p" is equal to the area of the rear face 8 of the rotor disc 6 which belongs to the second rear annular main chamber 41". The second front area "A_2f" is equal to the second rear annular area "A_2p", so that the resultant thrust is zero (F2_f=F_2p).

The working fluid passes through the blades 19 of the second main bladed ring 9" and of the second auxiliary bladed ring 15". Just downstream of the second auxiliary bladed ring 15", the working fluid has the third pressure "P3". Said third pressure "P3" generates a thrust F_3f=P3*A_3f. The third front annular area "A_3f" is equal to the sum of the area of the head surface of the circling ring 18 of the third main rotor bladed ring 9'" and the difference between the annular area of the front face 7 of the rotor disc 6 contained in the second front main chamber 35 and the area of the head surface of the root ring 17 of the second main rotor ring 9" turned towards said rotor disc 6.

The same third pressure "P3" acts on a third rear annular area "A_3p" of said rotor disc 6, generating an opposite thrust F_3p=P3*A_3p. Said third rear annular area "A_3p" is equal to the area of the rear face 8 of the rotor disc 6 which belongs to the third rear annular main chamber 41'". The third front area "A_3f" is equal to the third rear annular area "A_3p", so that the resultant thrust is zero (F3_f=F_3p).

The working fluid passes through the blades 19 of the third main bladed ring 9'" and of the third auxiliary bladed ring 15'". Just downstream of the third auxiliary bladed ring 15'", the working fluid has the fourth pressure "P4". Said fourth pressure "P4" generates a thrust F_4f=P4*A_4f. The fourth front annular area "A_4f" is equal to the sum of the area of the head surface of the circling ring 18 of the fourth main rotor bladed ring 9"" and the difference between the annular area of the front face 7 of the rotor disc 6 contained in the third front main chamber 36 and the area of the head surface of the root ring 17 of the third main rotor ring 9'" turned towards said rotor disc 6.

The same fourth pressure "P4" acts on a fourth rear annular area "A_4p" of said rotor disc 6, generating an opposite thrust F_4p=P4×A_4p.

Said fourth rear annular area "A_4p" is designed to balance, in whole or in part, the thrust of the external/atmospheric pressure P_atm acting from the outside on the shaft 4. The fourth rear annular main chamber 41"" is a chamber for the axial thrust compensation of the external/atmospheric pressure P_atm acting on the shaft 4 and the fourth rear annular area "A_4p" is a compensation area of the shaft 4.

In the embodiment of FIG. 1, the fourth main annular chamber 41"" and the fourth rear annular area "A_4p" are constrained by the maximum diameter of the rotor disc 6. As can be noted, in fact, the peripheral edge of the rotor disc 6 ends at the fourth main bladed ring 9"". The fourth rear annular area "A_4p" is equal to the difference between the respective front annular area "A_4p" and a cross section area "A_a" of the rotation shaft 4 according to the following relation: A_4p=A_4f−A_a.

Since the force acting on the first, second and third front areas is already perfectly balanced by the force acting on the first, second and third rear areas (F_1f=F1_p; F_2f=F_2p; F_3f=F_3p), the resultant axial force acting on the rotor 2 formed by the rotor disc 6 and the shaft 4 is equal to:

$$\text{Resultant}=F_4f-F_4p-F_\text{shaft}=(P4*A_4f)-(P4*A_4p)-P\text{atm}*A_a=P4*A_4f-P4*A_4f+P4*A_a-P\text{atm}*A_a=A_a*(P4-P_\text{atm})$$

Figure 5:
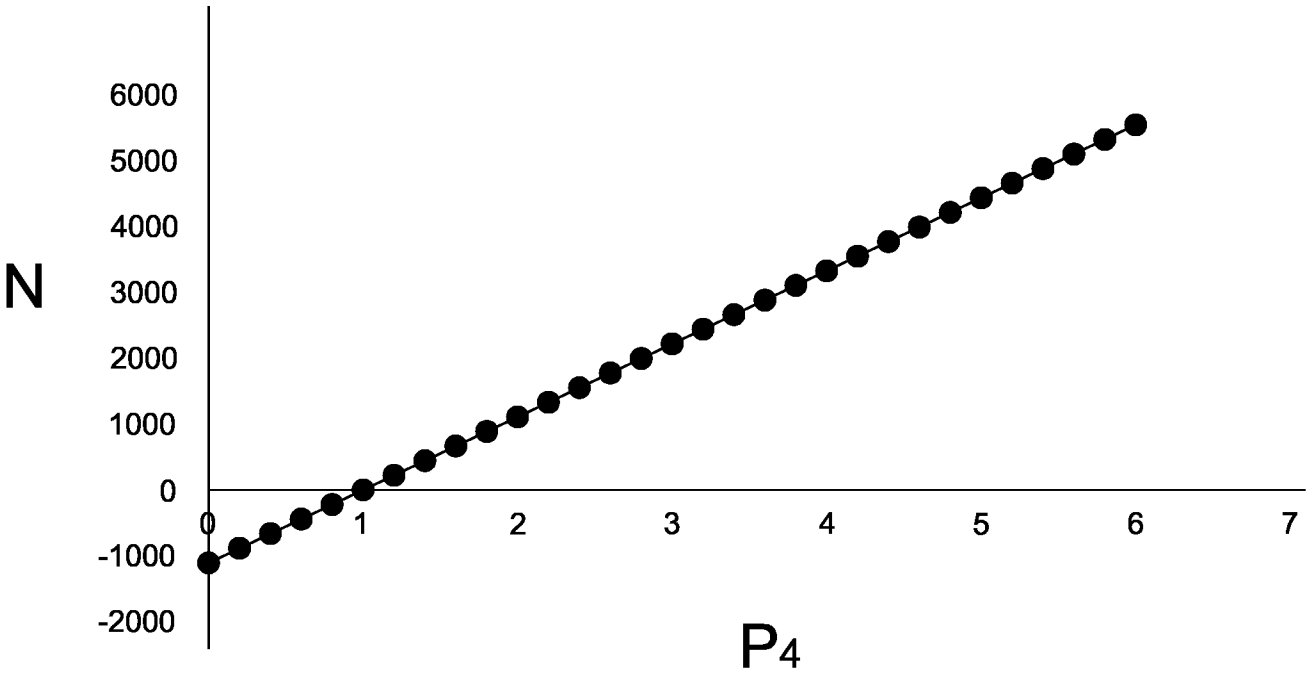
FIG. 5 is a graph illustrating the resultant axial force in the turbomachine of FIG. 1.

Therefore, the resultant axial force is a function of the area of the shaft and the difference between the outlet pressure "P4" of the last stator and the atmospheric pressure P_atm. If one assumes a shaft with a diameter of 120 mm and an atmospheric pressure equal to 101000 Pa, the thrust will be at a minimum when P4=0 bar absolute (under vacuum) and equal to −1142 N, and will be maximum for the maximum pressure to be considered, which in an ORC cycle usually never exceeds 6 bar absolute (normally between 0.5 and 1.5 bar absolute), and be equal to 5640 N (FIG. 5).

In the variant embodiment of FIG. 2, the fourth rear annular area "A'_4p" extends radially beyond the fourth main bladed ring 9"" and is such as to totally cancel out the resultant axial force for a given design condition (design point). The compensation area "A'_4p" of the shaft 4 is equal to the sum of the respective front annular area and a factor that is a function of the cross section area of the shaft 4 and the external/atmospheric pressure "P_atm". In other words, the compensation area of the shaft is increased by an additional area. Said additional area is obtained by increasing the diameter of the fourth radially outermost rear sealing ring 40"", i.e. the diameter of the fourth radially outermost rear annular main chamber 41"".

Called P_out the outlet pressure of the fourth main bladed ring 9"", i.e. in the spiral pathway 13, acting on a fifth front annular additional area "A_5f", the resultant is zero if:

$$\text{Resultant}=F_4f+F_5f-F_4p-F_\text{shaft}=(P4*A_4f)+(P_\text{out}*A_5f)-(P4*A'_4p)-P\text{atm}*A_a=0$$

$$\text{with } A'_4p=A_4p+A_5f$$

$$\text{and } A_4p=A_4f-A_a$$

$$P4*A_4f+P_\text{out}*A'_4p-P_\text{out}*A_4p-P4*A'_4p-P\text{atm}*A_a=0$$

$$P4*A'_4p-P_\text{out}*A'_4p=P4*A_4f-P_\text{out}*A_4p-P\text{atm}*A_a$$

$$A'_4p*(P4-P_\text{out})=P4*A_4f-P_\text{out}*(A_4f-A_a)-P\text{atm}*A_a$$

$$A'_4p*(P4-P_\text{out})=A_4f*(P4-P_\text{out})+A_a*(P_\text{out}-P_\text{atm})$$

The fourth rear annular area "A'_4p", such as to totally cancel out the resultant axial force for a given design condition, is therefore equal to:

$$A'_4p=A_4f+A_a*(P\text{out}-P_\text{atm})/(P4-P\text{out})$$

or, in other words:

$$A5_f=A_a*(P4-P_\text{atm})/(P4-P\text{out})$$

If the design provides for a high discharge pressure "P_out" of the machine, e.g. 15 bar, and if one assumes an expansion ratio of 1.2 on the last rotor (P4=1.2*P_out), the area "A5_f" necessary to eliminate the thrust is given by:

$$A5_f=A_a*(18-1)/(18-15)=5.66*A_a$$

Figure 6:
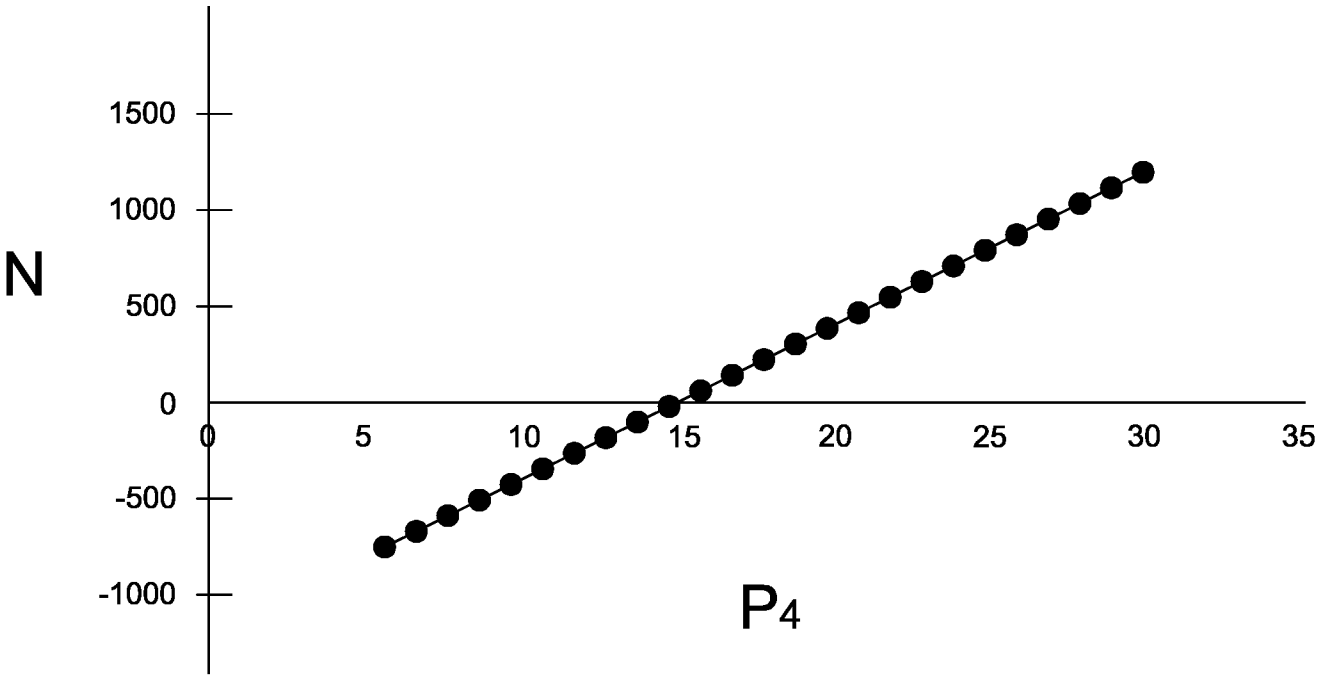
FIG. 6 is a graph illustrating the resultant axial force in the turbomachine of FIG. 2.

FIG. 6 illustrates that, with such an area, at a pressure of 15 bar the resultant axial force is zero. Such thrust values are even lower and are "withstandable" by the rolling bearings that are normally used in organic expanders. In fact, if one assumes a shaft with a diameter of 120 mm, an atmospheric pressure equal to 101000 Pa, a design outlet pressure "P4" of the last stator equal to 15 bar and an expansion beta of the last rotor equal to 1.2, the thrust will be at a minimum when "P4"=0 bar absolute (under vacuum) and equal to −1142 N, and will be maximum for the maximum pressure to be considered, which in an ORC cycle usually never exceeds 30 bar absolute, and be equal to +1142 N.

Comparing the two solutions, the second solution has a clear advantage when the discharge pressure "P_out" of the machine is high (>5 bar absolute).

In unillustrated variant embodiments, the rear annular compensation chamber is located in a different radial position, for example the radially innermost one.

Preferably, the rear annular compensation chamber is the one with the pressure closest to the external/atmospheric pressure.

In unillustrated variant embodiments, the respective axial passage for the working fluid is delimited between radially adjacent stages and the radial seals are interposed between each main and auxiliary bladed ring of a same stage.

Figure 3:
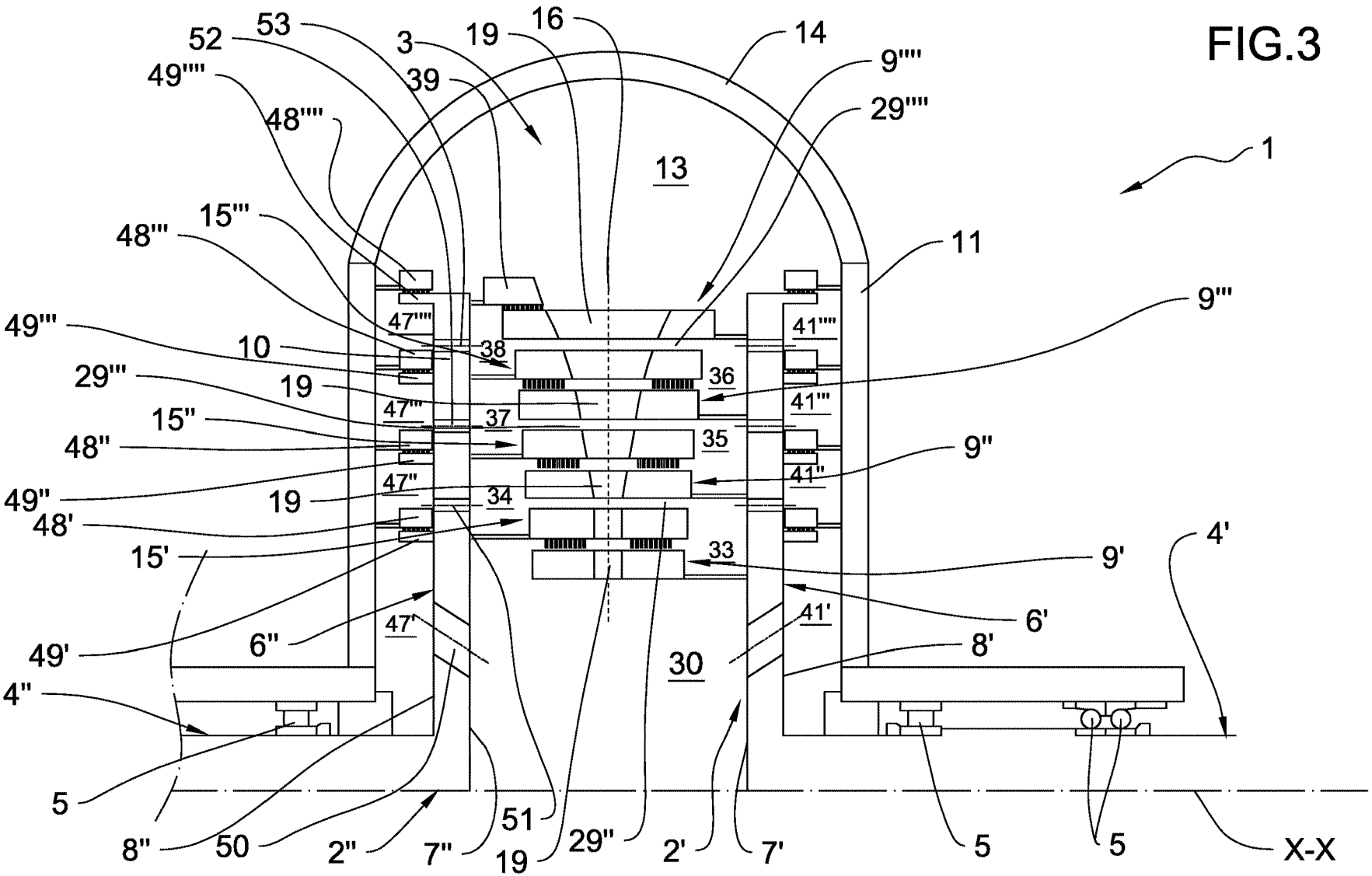
FIG. 3 illustrates a different embodiment of the turbomachine of FIG. 1.

FIG. 3 illustrates a further embodiment. The embodiment of FIG. 3 differs from the ones of FIGS. 1 and 2 since the turbine 1 is of the counter-rotating type. The turbine 1 comprises a first rotor 2' and a second rotor 2". The first rotor 2' comprises a first rotor disc 6' and a first rotation shaft 4' integral with the first rotor disc 6' and rotatable in the fixed casing 3 around the central axis "X-X". The first rotor disc 6' carries, on a front face 7', the main concentric bladed rings 9', 9", 9'", 9"".

The second rotor 2" comprises a second rotor disc 6" and a second rotation shaft 4" integral with the second rotor disc 6" and rotatable in the casing around the central axis "X-X" in an opposite direction relative to the first rotor disc 6'.

The second rotor disc 6" carries, on a front face 7", the concentric auxiliary bladed rings 15', 15", 15'", which are likewise bladed rotor rings. In particular, a first main bladed ring 9' is set in a radially innermost position and, moving away radially from the central axis, is followed by: a first auxiliary bladed ring 15', a second main bladed ring 9", a second auxiliary bladed ring 15", a third main bladed ring 9'", a third auxiliary bladed ring 15" and a fourth main bladed ring 9"". A radially outer sealing ring 39 extends from the front face 7" of the second rotor disc 6" and surrounds the circling ring 18 of the fourth main bladed ring 9"".

The structure of the substantially cylindrical front chamber 30, the annular front main chambers 33, 35, 36, the rear annular main chambers 41', 41", 41'", 41"", the second, third and fourth axial passages 29", 29'", 29"" and the second, third and fourth auxiliary front annular chambers 34, 37, 38 is substantially the same as described for the turbines of FIGS. 1 and 2.

Unlike those turbines, the turbine of FIG. 3 does not have the first axial passage 29' and does not have the first auxiliary front annular chamber 32 (but only the other three 34, 37, 38).

Furthermore, the second rotor disc 6" is also axially balanced according to the same principle as in the first rotor disc 6'. The turbine 1 of FIG. 3 in fact has auxiliary rear chambers 47', 47", 47'", 47"" for balancing the axial thrust. Concentric auxiliary sealing rings 48', 48", 48'", 48"" integral with the fixed casing 3 and auxiliary annular projections 49', 49", 49'", 49"" integral with the second rotor disc 6" delimit said auxiliary rear chambers 47', 47", 47'", 47"", which are in communication with the respective auxiliary front annular chambers 34, 37, 38 through respective ducts 50, 51, 52, 53 formed in the second rotor disc 6".

In other unillustrated variant embodiments, the radial turbomachine can be centripetal and/or can be a compressor and/or designed to work with steam.

The invention claimed is:

1. A radial turbomachine with axial thrust compensation, comprising:

a fixed casing;

a plurality of concentric main bladed rings arranged in the fixed casing around a central axis;

a plurality of concentric auxiliary bladed rings arranged in the fixed casing around said central axis; wherein the auxiliary bladed rings are radially alternated with the main bladed rings; wherein blades of said main bladed rings and of said auxiliary bladed rings delimit a radial path for a working fluid;

at least one rotor comprising a rotor disc and a rotation shaft integral with the rotor disc and rotatable in the fixed casing around the central axis, wherein the rotor disc carries, on a front face, the main bladed rings;

wherein said main and auxiliary bladed rings delimit, with the rotor disc, a plurality of concentric front main chambers at different pressures, said concentric front main chambers being delimited by front areas of the rotor disc;

wherein a plurality of concentric rear annular main chambers, each in fluid communication with a respective front main chamber and at the same pressure as said respective front main chamber, is delimited between a rear face of the rotor disc and the fixed casing, said concentric rear annular main chambers being delimited by rear annular areas of the rotor disc; and wherein all the rear annular areas are identical to the respective front areas except for one, which is a compensation area configured to compensate, at least in part, for thrust of external pressure acting on the rotation shaft.

2. The turbomachine according to claim 1, wherein radial seals are interposed between a main bladed ring and a radially outermost auxiliary bladed ring, to prevent an axial flow of the working fluid, and wherein between said main bladed ring and a radially innermost auxiliary bladed ring a respective axial passage for the working fluid is delimited; wherein said axial passage for the working fluid intersects the radial path and is in fluid communication with the respective front main chamber.

3. The turbomachine according to claim 1, wherein a plurality of concentric main sealing rings is arranged at the rear face of the rotor disc, wherein said main sealing rings, together with the fixed casing, delimit the concentric rear annular main chambers.

4. The turbomachine according to claim 2, wherein each rear annular main chamber is located at the respective front main chamber and in fluid communication with said respective front main chamber through at least one duct formed in the rotor disc.

5. The turbomachine according to claim 4, wherein said at least one duct extends substantially parallel to the central axis (X-X).

6. The turbomachine according to claim 1, wherein the compensation area is the radially outermost of the rear annular areas.

7. The turbomachine according to claim 6, wherein a radially outermost main bladed ring is placed at a peripheral edge of the rotor disc and the compensation area is equal to the difference between the respective front area and a cross section area of the rotation shaft.

8. The turbomachine according to claim 6, wherein a peripheral edge of the rotor disc extends radially beyond a radially outermost main bladed ring and the compensation area is equal to the sum of the respective front area and a factor that is a function of the cross section area of the rotation shaft and of an external pressure.

9. The turbomachine according to claim 8, wherein in order to completely cancel out a resultant axial force, the compensation area is equal to: $A'_{4p}=A_{4f}+A_a*(P_{out}-P_{atm})/(P_4-P_{out})$.

10. The turbomachine according to claim 2, wherein there is only one rotor and pairs of radially adjacent main and auxiliary bladed rings delimit, with the rotor disc, one of the concentric front main chambers and, with the fixed casing, an auxiliary front chamber, wherein said concentric front main chambers and auxiliary front chambers are mutually connected by the respective axial passage.

11. The turbomachine according to claim 2, comprising a first rotor and a second rotor; wherein the first rotor comprises a first rotor disc carrying, on a front face, the concentric main bladed rings; wherein the second rotor comprises a second rotor disc carrying, on a front face, the concentric auxiliary bladed rings; wherein pairs of radially adjacent bladed rings delimit, with the first rotor disc, one of the concentric front main chambers and, with the second rotor disc, an auxiliary front chamber, wherein said concentric front main chambers and auxiliary front chambers are mutually connected by the respective axial passage.

12. The turbomachine according to claim 1, wherein the concentric front main chambers comprise:

a substantially cylindrical central front chamber, defining a front circular area; and a plurality of main annular chambers arranged around the cylindrical central front chamber, each defining a front annular area.

13. The turbomachine according to claim 1, wherein said turbomachine is a centrifugal radial turbine.

* * * * *